US005561451A

United States Patent [19]

Ogata et al.

[11] Patent Number: 5,561,451

[45] Date of Patent: Oct. 1, 1996

[54] SUBLIMATION TYPE PRINTER AND PHOTOGRAPHIC PAPER THEREFOR

[75] Inventors: Masanori Ogata, Saitama; Shuji Sato, Kanagawa; Hiroyuki Shiota, Chiba, all of Japan

[73] Assignee: Sony Corporation, Japan

[21] Appl. No.: 183,836

[22] Filed: Jan. 21, 1994

[30] Foreign Application Priority Data

Jan. 27, 1993 [JP] Japan ..... 5-011241
Jan. 28, 1993 [JP] Japan ..... 5-012106

[51] Int. Cl.[6] ..... B41J 2/04; B41J 2/14; B41J 2/175

[52] U.S. Cl. ..... 347/51; 347/48; 347/88

[58] Field of Search ..... 347/51, 48, 99, 347/88, 85, 15

[56] References Cited

U.S. PATENT DOCUMENTS

| | | | |
|---|---|---|---|
| 3,798,365 | 3/1974 | Browning et al. | 347/51 X |
| 4,827,290 | 5/1989 | Yoritomo et al. | 347/245 |
| 5,021,808 | 6/1991 | Kohyama | 347/51 X |
| 5,023,625 | 6/1991 | Bares et al. | 347/48 |
| 5,170,178 | 12/1992 | Yokoyama | 346/76 |
| 5,270,730 | 12/1993 | Yaegashi et al. | 347/88 X |

*Primary Examiner*—Benjamin R. Fuller
*Assistant Examiner*—David Yockey
*Attorney, Agent, or Firm*—Ronald P. Kananen

[57] ABSTRACT

A laser sublimation type color video printer includes a plurality of dye tanks for accommodating solid powder form sublimating dyes. The dye tanks are communicated with liquid dye vaporizing sections via respective accommodating passages which are formed as capillary tubes provided with heating elements for liquefying dyes introduced from the dye tanks. The heating elements may also be active to heat the surface of photographic paper via a protective layer of the head portion of the printer. Each of the vaporizing sections comprises a plurality of vaporizing pores having a light-heat converting element projected thereinto from a head base of the printer. A laser source is mounted over the light-heat converting element, which may comprise a heat resistant light transmitting portion having a light-heat converting layer disposed on a lower end thereof. The vaporizing pores allow a sufficient amount of liquid dye to be adhered to the lower side of the light-heat converting element to be vaporized and adhered to the surface of the photographic paper upon irradiation by a laser beam from the laser source. An area of the light-heat conversion element is limited to an area which may be covered by the vaporized dye according to an irradiation operation.

32 Claims, 12 Drawing Sheets

FIG.1
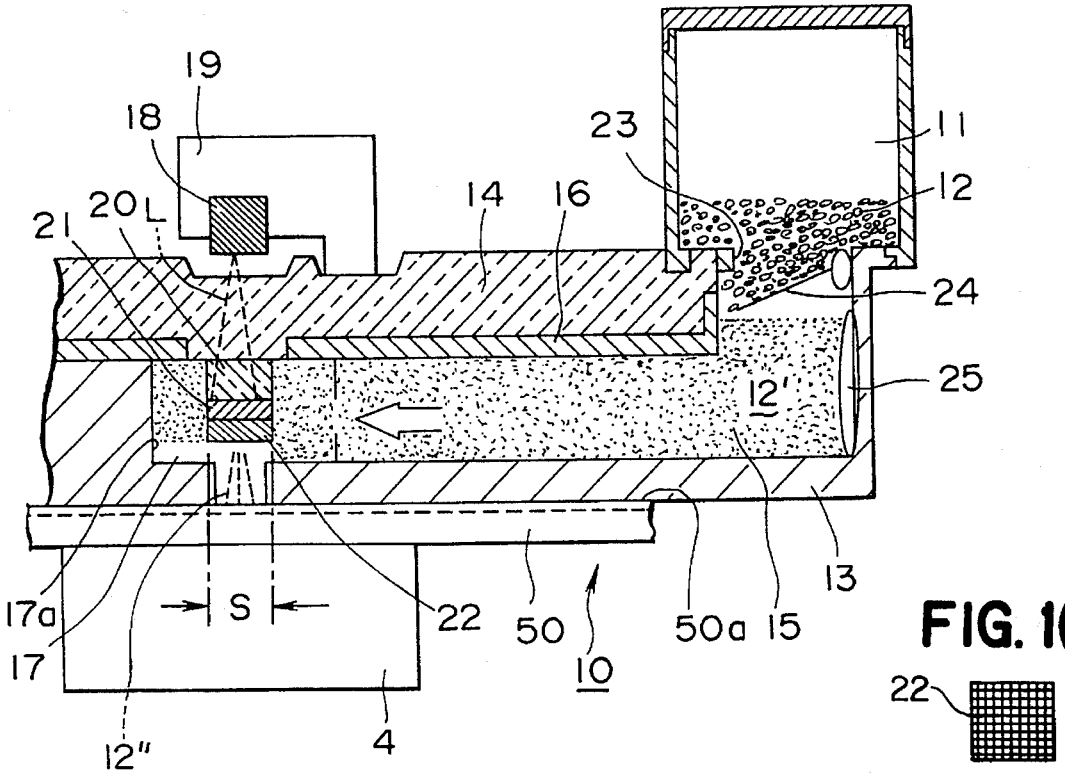
FIG. 1(a)
FIG.2
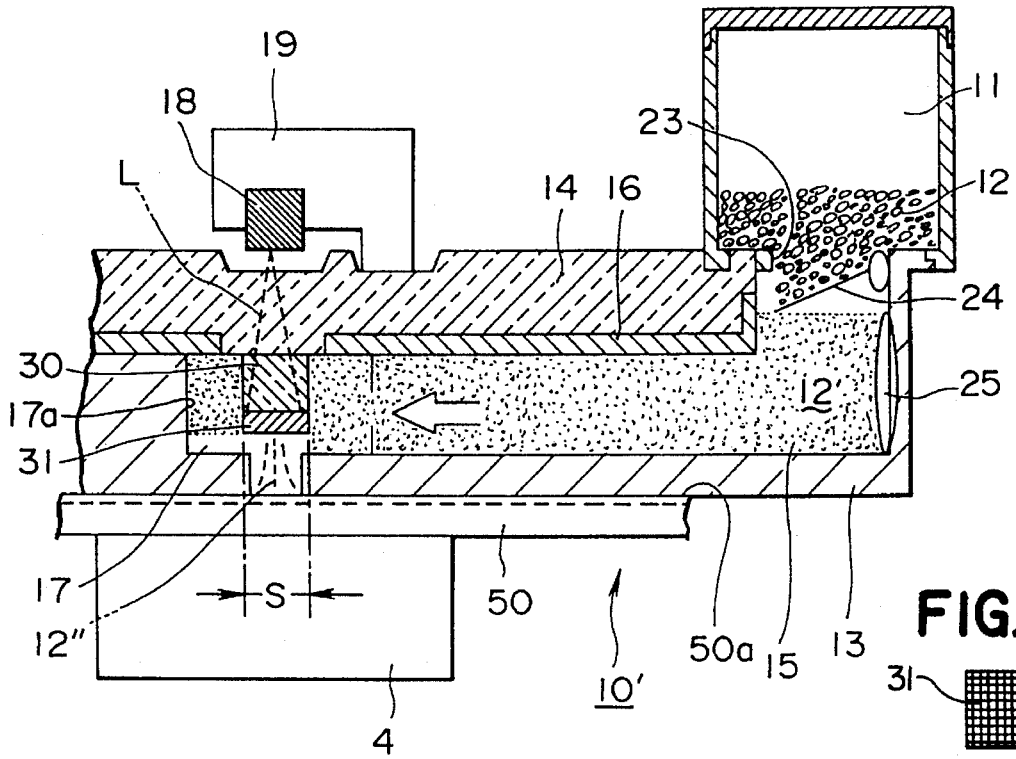
FIG. 2(a)
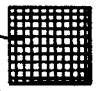

SUBLIMATION TYPE PRINTER AND PHOTOGRAPHIC PAPER THEREFOR

BACKGROUND OF THE INVENTION

1. Field of The Invention

The present invention relates generally to a printer such as a laser, sublimation type color video printer for making a thermal imprint of still video or television images etc., on photographic paper using sublimation type dyes, or the like.

2. Description of The Related Art

Sublimation type printers have been proposed for applications requiring impression of video and or television images on photographic paper or the like. Such types of printers are favored since they require no thermal head or ink ribbon, and may operate on low levels of electricity. In addition they may be substantially small in size and low in cost.

One such sublimation type video printer is disclosed in Japanese Patent Application (First Publication) No. 4-300587. Such a conventional type of sublimation printer will be explained in detail with reference to FIGS. 14 and 15. As may be seen in FIG. 14, a laser sublimation type color video printer (hereinbelow: printer) 1 receives a cassette 3 containing photographic paper 50'. The printer 1 includes a planar base 4 for printing on a chassis 2, the chassis 2 is covered by an outer case 2*a*. A discharge slot 2*b* is provided in the front face of the outer case 2*a* and, behind the discharge slot 2*b*, a feed roller 6*a* is provided, driven by a motor 5. The feed roller 6*a* contacts a pressure driven roller 6*b* such that the photographic paper 50' may be discharged from the printer 1 between the rollers 6*a*, 6*b*. The printer 1 further includes a head driving circuit substrate 7 connected to a head assembly 10P which is disposed on the planar base 4. The substrate 7 and the head assembly 10 are connected by a flexible wire harness 7*a*.

Referring now to FIGS. 15 and 16, the head assembly is provided with dye tanks (11Y (yellow), 11M (magenta), 11C (cyan)) 11, accommodating solid sublimation type dyes 12, of each of the above-noted primary colors. The dyes 12 may be in solidified powder form, for example. A dye passage 15 (15Y, 15M, 15C) connects between each of the tanks 11 and vaporizing sections 17 over a wear-resistant protective layer 13 of the head assembly 10P. The protective layer 13 is made of a high strength material and is located at the lower side of a head base 14 made of glass, transparent ceramic, or the like. The dye passage 15 allows passage of the dye 12 as liquefied dye 12' after heating by heating units 16D (FIG. 15), which comprise a resistor provided at the lower surface of the head base 4. The liquefied dye 12' from each of the dye passages 15 is brought to the vaporizing sections 17. There may, for example, be three vaporizing sections 17Y, 17M and 17C, one for each of the primary colors yellow, magenta and cyan. A laser beam source (i.e. a semiconductor laser)18 is mounted above the head base 14 on a mounting stand 19. Vaporizing pores 17*a* of the vaporizing sections 17 are irradiated by laser beams L generated at the laser sources 18.

As best seen in FIG. 15, each of the vaporizing sections 17 comprise a plurality of pores 17a in each of which an upper transparent insulation layer 20' is provided at a lower side of the head base 14 atop a light-heat conversion layer 21' and a lower adhesion layer 23'. The light-heat conversion layer 21' absorbs light from the laser beam L and converts same into heat, while the adhesion layer 23' has glass beads 22' inset therein for carrying vaporized dye 12" vaporized by the laser beam L at each vaporizing pore 17*a*. The transparent insulation layer 20' is made of a clear PET resin, for example, and the light-heat conversion layer 21' is formed by applying a binder and fine carbon particles to the lower side of the transparent insulation layer 20' Glass beads 22' are selected with a size from 5–10 microns in diameter. The heating units 16 are active to allow the solid dye 12 to liquefy and be maintained as liquefied dye 12' and to flow down to be held at the glass beads 22' to be converted to vaporized dye 12" according to irradiation of the vaporizing section 17 by the laser beam L.

Sheets of the photographic paper 50' are drawn singly out of the cassette 3 between the planar base 4 and the head assembly 10P to be fed to the rollers 6*a*, 6*b*. The head assembly 10P is biased against the plane base 4 under a light load (approx. 50 g) by load applying springs 9, as seen in FIG. 14.

A plurality of laser sources 18 for each of the colors Yellow, Magenta and Cyan (hereinbelow: Y, M, C) are aligned at the head assembly 10P in three rows to perform heating and liquefaction respectively for the dyes 12Y, 12M and 12C. The dyes 12 in each of the dye tanks 11Y, 11M and 11C are heated to the melting point by the heating elements 16 and quantitatively supplied to each pore 17*a* of the plurality of vaporizing portions 17Y, 17M, 17C via the passages 15. The dye 12 may move from the tanks 11 to the glass beads 22' via a simple capillary effect.

For printing, when the photographic paper is positioned between the rollers 6*a*, 6*b*, a signal is sent to the head portion for each one line of an image to be printed and for each single color laser beams L are generated accordingly at the laser sources 18 which are then converted to heat at the respective light-heat converting layers 21' such that an appropriate amount of liquefied dye of each color Y, M and C, is held at the glass beads 22' to be vaporized by the applied heat to be imprinted successively in the order of Y, M and C to a dye receiving layer 50'*a* at the surface of the photographic paper 50'. The imprinted photographic paper 50' is then fed between the protective layer and the planar base 4 to result in a finished color print.

FIG. 18 shows a conventional type of photographic paper utilized in such a laser sublimation type printer 1 as described above. As may be seen, the photo paper 50' is a laminate comprising of a dye receiving surface layer 50'*a*, a light-absorbing layer 50'*e*, a polypropylene layer 50'*b*, a base paper layer 50'*c* and a polypropylene layer 50'*d*. According to this, the light-absorbing layer 50'*e* of the photographic paper 50' absorbs a portion of the light from the laser source 18 and converts it to heat which heats the dye receiving surface layer 50*a* to aid the vaporized dye 12" in forming a thermal imprint on the dye receiving surface layer 50*a*.

As seen in FIG. 16, the head portion 10P of such a laser sublimation type printer 1 may have an elongate pore 17*b* formed along one side thereof. This elongate pore 17*b* allows irradiation of the photographic paper by a second laser Lo for removing discoloration caused by the presence of a light absorbing agent present in the light absorbing layer 50'*e* of the photographic paper 50'. That is, the agent present in the light absorbing layer 50'*e* gives the photographic paper 50' pale tint, irradiation by the laser beam Lo whitens the light absorbing agent to produce a sharper more attractive image on the photographic paper 50'.

However, according to such a conventional laser sublimation printer arrangement, since the light-heat converting layers 21' must be formed by application of the binder and carbon particles to the transparent insulation layer, if a thickness of the layer becomes greater than 1 micron, heat capacity becomes too large (specific heat is generally 1.3J/g°C. which is substantially high) and thermal conduction efficiency is reduced (i.e. 0.15w/m°C.), also, the diffusion speed of heat becomes slower. Therefore, when light energy distribution of the laser beam is non-uniform, such as a gaussian distribution or the like, heat conversion Follows this distribution and it becomes difficult to imprint colors uniformly. Also, since the dyes 12 are brought to the glass beads 22' by a capillary phenomenon, and the sizes of the glass beads 22' may vary slightly, it is difficult to assure that a uniform amount of dye is brought to each vaporizing section 17 and for this reason also, uniformity of color is difficult to assure.

In addition, the light-heat converting layer 21' itself is subject to destruction due to generated heat and the PET resin material of the insulation layer 21' is apt to incur thermal damage at around 140° C. Also, the area of the light-heat converting layer 21' is larger than an irradiation area of one spot of light from the laser source 18 and an imprint area of the dye 12 and an energy efficiency of heat imprinting is degraded as excessive heat is lost.

Further, since the glass beads 22' are used as the holding layer for retaining the liquefied dye 12' prior to vaporizing, an adhesion layer 23' must be provided and the problem of heat resistance is incurred. That is, while the supply of liquefied dye 12' to the glass beads 22' depends on the diffusion speed of the dye 12 itself, it is impossible to supply the dye 12 to the glass beads 22' at significantly high speeds since the speed of supply varies according to operating influences and the influence of the respective laser sources 18.

Also, in order to maintain a high resolution for assuring good image quality, the vaporizing sections 17 must be provided in rows and spaced about 30 microns apart. This limits material which can be used for the protective layer 13 and incurs high production costs in manufacture for etching and adhesion technique, etc. It is also noted that, according to the conventional structure, a separate, dedicated laser source is required For operating in the elongate pore **17*b*** for irradiating the light-absorbing agent.

Thus, it has been required to provide a sublimation type laser color video printer in which the above drawbacks may be alleviated.

SUMMARY OF THE INVENTION

It is therefore a principal object of the present invention to overcome the drawbacks of the related art.

In order to accomplish the aforementioned and other objects, a laser sublimation type printer is provided, comprising: a solidified dye accommodating tank containing solid form sublimation type dye and mounted on an upper side of a head portion of the printer; a vaporizing section including a vaporizing pore which is open on a lower side thereof through a protective layer which contacts a surface of photographic paper on which printing is to be carried out; a liquefied dye accommodating passage defined in the head portion and communicating an outlet of the dye tank with an interior space of the vaporizing pore; heating means provided proximate the liquefied dye accommodating passage for melting the solid form sublimation type dye and maintaining the dye in a liquid state; light-heat converting means projected into the vaporizing pore, a lower side thereof receivable of liquid dye introduced to the vaporizing pore from the liquefied dye accommodating passage, an area of the lower side of the light-heat converting means being limited to an area of the photographic paper capable of being covered by a predetermined amount of the dye according to vaporizing operation of the printer; a laser source mounted above each of the light-heat converting portions and active to effect vaporizing operation by irradiating the light-heat converting means for vaporizing liquefied dye adhered to the lower side thereof.

BRIEF DESCRIPTION OF THE DRAWINGS

In the drawings:

FIG. 1 is a cross-sectional view of a head assembly of a laser sublimation type printer according to a first preferred embodiment of the invention;

FIG. 1A is a bottom plan view of a liquid dye holding layer comprising a metallic film formed into a mesh shape.

FIG. 2 is a cross-sectional view of a head assembly of a laser sublimation type printer according to a second preferred embodiment;

FIG. 2A is a bottom plan view of a light-heat conversion layer having a lower side formed as a mesh shape.

DESCRIPTION OF THE PREFERRED EMBODIMENT

Figure 3A:
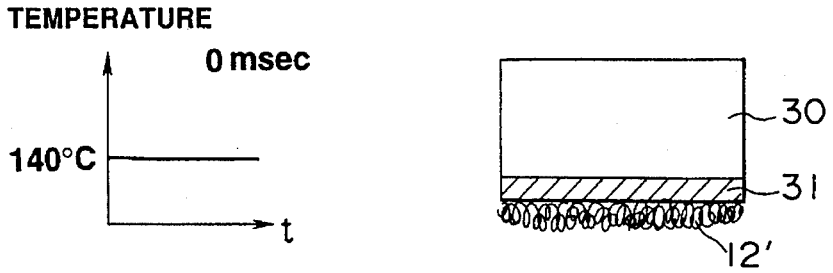
FIGS. 3(*a*)–3(*d*) are explanatory views showing the relation between temperature change and plastic deformation in a heat-resistant light-transmitting resin material and the flow of dye at subsequent timings of laser irradiation.
Figure 3B:
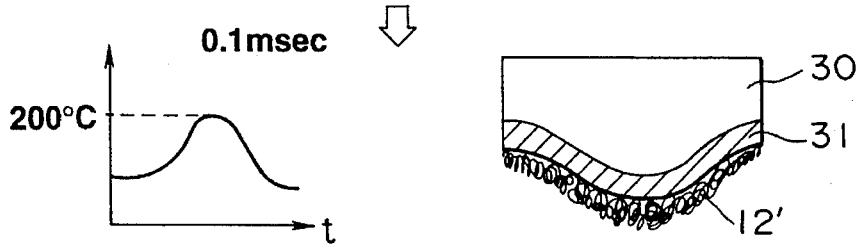
Figure 3C:
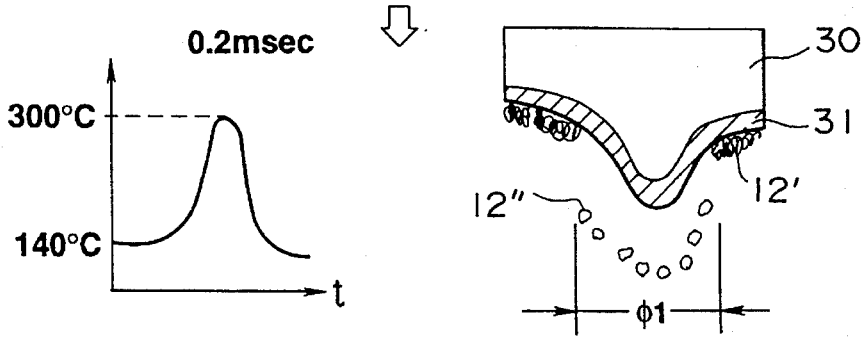
Figure 3D:
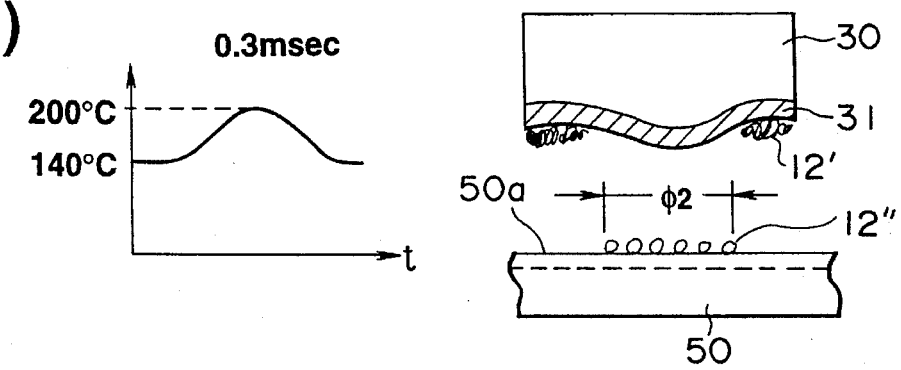

A first preferred embodiment of a laser sublimation type color video printer (hereinbelow: printer) according to the invention will be described in detail hereinbelow with reference to the drawings. The components and arrangement of the printer of the invention corresponds closely with the conventional structure and thus, the same numerals will be used to indicate like parts.

Referring now to the drawings, FIG. 1 shows a cross-sectional view of a head portion 10 of the laser sublimation type printer of the first embodiment. As seen in the drawing, the construction of the head portion 10 is generally the same as that of the conventional arrangement, including dye tanks 11Y, 11M and 11Y accommodating sublimating dyes 12Y, 12M and 12C and having passages 15 formed between a head base 14 made of glass, transparent ceramic, or the like, and a protective layer 13 made of a high-strength material. Also provided are heating elements 16 which may be relatively elongated compared with the related art as shown in FIG. 1. The heating elements 16 are comprised of electrical resistors according to the present embodiment, and a plurality of laser sources 18, such as semiconductor laser chips which are mounted on the head base 14 via stands 19 so as to position the laser sources 18 over the vaporizing pores 17*a* of vaporizing sections 17.

In addition, according to the present embodiment, a non-return valve 24 is provided between each of the solid dye 12 accommodating dye tanks 11 and the liquid dye 12' accommodating dye passages 15, as well as a vibrating unit 25 acting as a dye pressurizing and supply means. The vibrating unit 25 is constituted by a bimorph, piezo-element or the like and works to urge dye 12 from the dye tanks 11 toward the vaporizing sections 17 communicating with each of the liquid dye passages 15. The non-return valve functions so as to close an outlet 23 of the dye tank 11 during activation of the vibrating unit 25 and opens the outlet 23 when no pressurizing (vibration of the vibrating unit 25) takes place. Thus, when the non-return valve 24 is opened, powder form solid dye 12 is dropped into the liquid dye passage 15 where it is heated to become liquid dye 12' and pressurized according to activation of the vibrating unit 25 to distribute the dye 12' to the vaporizing sections 17 in communication with the liquid dye passage 15.

In addition, instead of the insulating member 20' of the conventional each of, the vaporizing sections 17 of the present embodiment is provided with a heat resistant, light transmitting base 20 which simultaneously exhibits high heat resistance, with good light transmission and insulative characteristics. Laminated to a lower side of the base 20, a light-heat conversion layer 21 is provided for receiving the light of the laser beam L through the light transmitting base 20 and converting same to heat. At a lower side of the light-heat conversion layer 21, a liquid dye holding layer 22 is provided for retaining liquefied dye introduced to the vaporizing section 17 from the liquid dye passage 15 to be vaporized by heat generated according to irradiation of the light-heat conversion layer 21 by the laser beam L.

In detail, according to the present embodiment, the heat resistant, light transmitting base 20 is formed of a transparent film material applied on the head base 14 and having a heat resistance of not less than 180° C., thermal conductivity of not more than 1w/m°C., near infrared transmittance of not less than 85% for a thickness of 10 microns, a specific heat of not more than 2J/g°C. and a density of not more than 3g/cm$^3$.

The light-heat conversion layer 21 is formed as a metallic thin film of nickel-cobalt alloy having no binder, for example, applied by vapor deposition, sputtering, or the like and having an infrared transmittance of not less than 0.9% for a thickness of not more than 1 micron, a specific heat of not more than 0.5 J/g°C., thermal conductivity of not less than 20 w/m°C. and a density of not more than 20 g/cm$^3$. In addition, the area of the light-heat conversion layer 21 is limited to an imprint area S of the vaporized dye 12" (FIG. 1).

The liquid dye holding layer 22 according to the present embodiment is a metallic thin film formed directly on the light-heat conversion layer 21. The metallic film of the liquid dye holding layer 22 is formed into a mesh shape (FIG. 1A) by etching processing or the like so as to retain the liquefied dye 12'.

According to the above-described composition, the printer according to the present invention is capable of supplying liquefied dye 12' to the pores 17*a* of the vaporizing sections in uniform amounts due to the mesh structure of the liquid dye holding layer 22 and at high speed due to the provision of the heating elements 16 and the vibrating units 25. Further, provision of the non-return valve 24 prevents liquefied dye from being introduced to the dye tanks 11 and assists the vibrating units 25 in applying low pressure to the liquefied dye which, in combination with the heating elements and the capillary phenomenon, allows the printer to print at higher speed with greater color uniformity.

In addition, since the light-heat conversion layer 21 is formed of a metallic thin film, it is possible to improve the heat resistance of the light-heat conversion layer 21 to allow continuous use thereof. Since the thickness of the light-heat conversion layer is held low and the area thereof is limited to the imprint area S of the vaporized dye 12", the heating capacity can be held small and the area surrounding the light-heat conversion layer 21 can in effect be insulated by the liquefied dye 12' to enhance the overall thermal efficiency of the arrangement.

Since the heat resistant, light transmitting base 20 is highly heat resistant, it is able to withstand continuous use. Also, the thermal conductivity can be made large while thermal diffusion is rapidly performed in over the entire area thereof even when the light energy distribution from the laser beam L is non-uniform such as a gaussian distribution, for example. Thus, uniform temperature distribution can be realized. Further, because the light-heat conversion layer 21 to the is applied directly to the heat resistant, light transmitting base 20 by sputtering or the like, it is possible to suitably alter and optimize the light absorption ratio and the thermal conductivity by increasing or decreasing a supply amount of oxygen during deposition.

Also, since the liquid dye holding layer 22 is formed as a metallic thin film directly over the light-heat conversion layer 21, no adhesive layer is required and heat efficiency is improved while a size and complexity of the structure is reduced. Also, the thin metallic film of the liquid dye holding layer 22 is processed into a mesh shape and, by varying the pitch and depth of the mesh during processing, it can be assured that a suitable amount of liquefied dye 12' may be always and certainly held. Because the liquid dye holding layer 22 is formed of a metallic thin film, the heat resistance thereof is considerably improved and thus will not deteriorate under heavy or continuous use.

According to the above, the dyes 12 in each of the dye tanks 11Y, 11M and 11C are heated to the melting point by the heating elements 16Y, 16M and 16C and quantitatively supplied to each pore 17*a* of the plurality of vaporizing sections 17 via the dye passages 15. The liquefied dye 12' may move from the tanks 11 to the vaporizing pores 17*a* smoothly and at high speed due to the provision of the vibrating units 25 and the heating elements 16.

Figure 17:
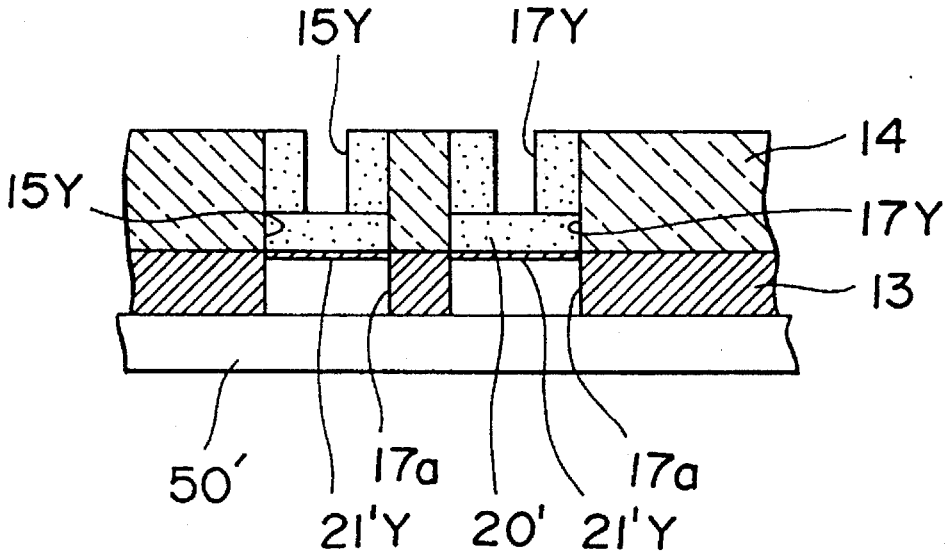
FIG.17 (PRIOR ART)
FIG. 17 is an enlarged cross-sectional view of an important feature of the head assembly of the conventional printer of FIG. 16.
Figure 18:
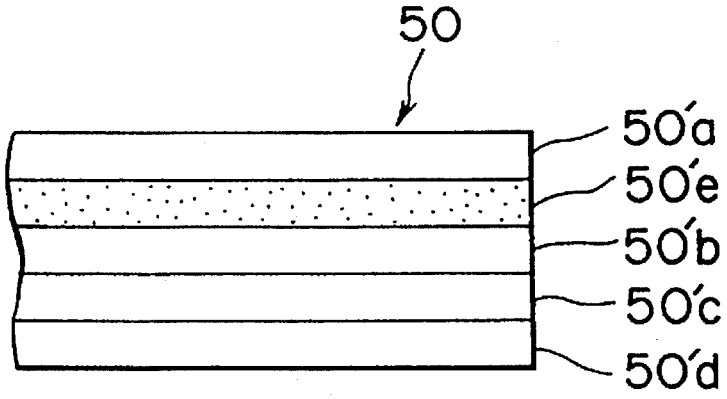
FIG.18 (PRIOR ART)
FIG. 18 is a cross-sectional view of photographic paper utilized in the conventional printer of FIGS. 14 and/or 16.

For printing, when the photographic paper is positioned between the rollers 6*a*, 6*b* (FIG. 17), a signal is sent to the head portion for each one line of an image to be printed and for each single color. Laser beams L are generated accordingly at the laser sources 18 which are then converted to heat at the respective light-heat converting layers 21 such that an appropriate amount of liquefied dye of each color Y, M and C, is held at the dye holding layer 22 of each of the vaporizing pores 17*a* to be vaporized by applied heat converted from the light of the laser beam L by the light-heat conversion layer 21 to be imprinted successively in the order of Y, M and C to a dye receiving layer 50*a* at the surface of the photographic paper 50. The imprinted photographic paper 50 is then fed between the protective layer 13 and the plane base 4 to output a finished color print.

Hereinbelow a second embodiment of a laser sublimation type printer will be explained with reference to FIGS. 2 and 3. When practical, components of the second embodiment will be referred to by the same reference numbers as like components of the first embodiment.

Referring to FIG. 2, a cross-sectional view of a head portion 10 of a printer according to a second preferred embodiment is shown. As may be seen the structure of the head portion 10 is substantially identical to that of the previous embodiment, however, according to the present embodiment, within the vaporizing pore 17*a*, a heat resistant, light transmitting base 30 is formed on a lower surface of the head base 14. The heat resistant, light transmitting base 30 also has insulative properties and may be of aromatic polyamide (aramide), for example.

Laminated to a lower side of the heat resistant, light transmitting base 30 a light-heat conversion layer 31 is formed as a metallic thin film of a nickel-cobalt alloy, for example, applied by vapor deposition, sputtering, or the like. Similarly to the previous embodiment, the area of the light-heat conversion layer 31 is limited to an imprint area S of the vaporized dye 12". A lower side of the light-heat conversion layer 31 may be formed as a mesh shape for retaining liquefied dye introduced to the vaporizing pore 17*a*.

According to the present embodiment, no liquid dye holding layer is provided, but rather the lower surface of the light-heat conversion layer 30 acts so as to retain a thin layer of liquid dye 12'. Referring now to FIGS. 3(*a*)–3(*d*), a timing chart is shown accompanying an enlarged cross-sectional view of the light-heat conversion layer 31 and the heat resistant, light transmitting base 30. As may be seen, the material of the heat resistant, light transmitting base 30 is selected for thermal expansion characteristics as shown in FIG. 3. As may be seen, according to irradiation by the laser beam L, the material of the heat resistant, light transmitting base 30 is caused to expand rapidly (FIG. 3(*b*)), and thus, due to kinetic energy generated by the expansion, a thin layer of liquefied dye 12' adhered to the lower side of the light-heat conversion layer 31 is caused to vaporize and fly off (FIG. 3(*c*)) and onto the surface 50*a* of the photographic paper 50 (FIG. 3(*d*)).

In FIG. 3(*c*), $\phi 1$ represents a diameter of an irradiated spot ($\phi 1$ =100μm), and in FIG. 3(*d*), $\phi 2$ represents a diameter of one 'dot' or imprinted picture area ($\phi 2$=60–80μm). In this manner the vaporized dyes 12"Y, 12"M and 12"C are imprinted on the surface 50*a* of the photographic paper 50 in the order given, such that layers of dye of a single color are printed respectively one over the other while the photographic paper 50 is fed between the plane base 4 and the protecting layer 13 resulting in a full color printed image.

In addition, the area of the light-heat conversion layer 31 is limited to the imprint area S of the vaporized dye 12", thus the heating capacity can be held small and the area surrounding the light-heat conversion layer 21 is insulated by the liquefied dye 12' to enhance the overall thermal efficiency of the arrangement. Also, since the heat resistant, light transmitting base 30 is made of aromatic polyamide, the heat resistance is enhanced so that the heat resistant, light transmitting base 30 may endure continuous use.

Figure 4:
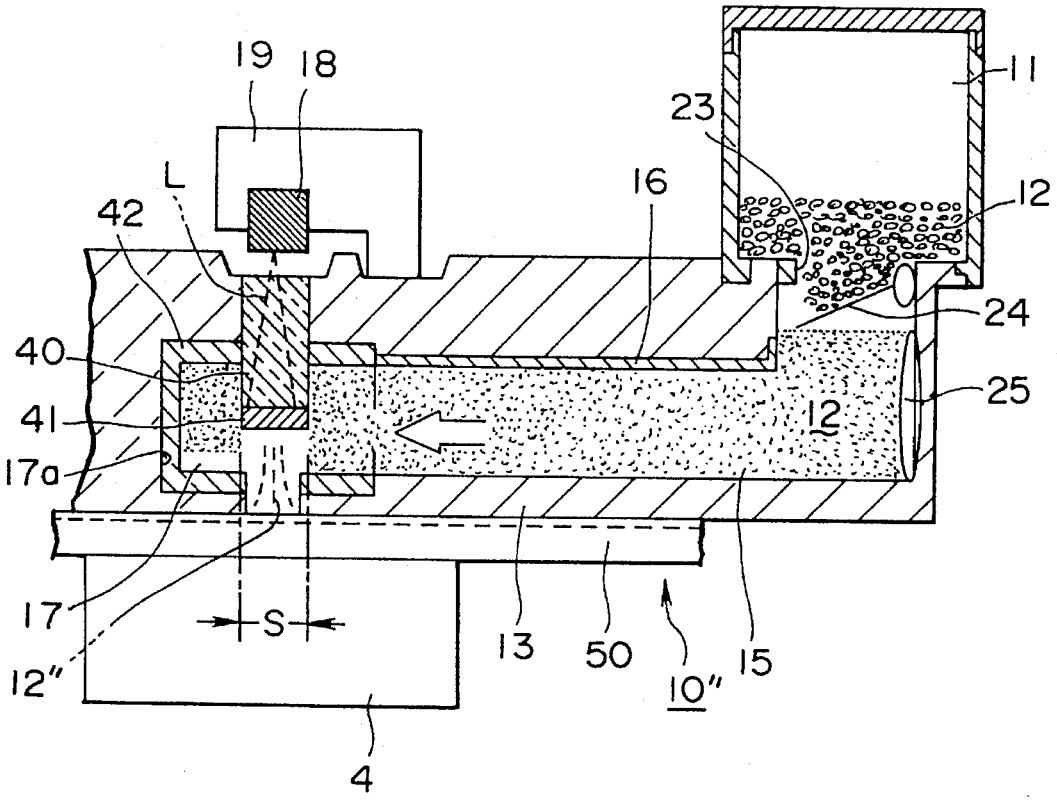
FIG. 4 is a cross-sectional view of a head assembly of a laser sublimation type printer according to a third preferred embodiment.

FIG. 4 shows a third embodiment of a laser sublimation type color video printer 1 according to the invention. The structure of the head portion 10 of the present embodiment is substantially the same as that of the previously described embodiments, including a non-return valve 24 and a vibrating unit 25. However, according to this embodiment, an optical fiber 40 is provided in the vaporizing pore 17*a* for functioning as a light transmitting means for the laser beam L. According to this, the laser beam L is surely led into the vaporizing pore 17*a* without leakage, thus energy efficiency is assured. At a lower side of the optical fiber 40 a light-heat conversion layer 41 is formed of a metallic thin film of nickel-cobalt alloy, for example, applied by vapor deposition, sputtering, or the like. In addition, each of the vaporizing pores 17*a* is surrounded by an insulating material 42 to increase a heating efficiency and durability of the head portion 10.

As noted for the previous embodiments, the area of the light-heat conversion layer 41 is limited to the imprint area S of vaporized dye 12", thus the heating capacity can be held small and the area surrounding the light-heat conversion layer 41 is insulated by the insulating material 42 and the liquefied dye 12' to prevent heat loss to the area surrounding the vaporizing pore 17*a*, thus a vaporization ratio of the sublimation type dyes 12 is enhanced.

According to the above structure, thermal conductivity is high and thermal diffusion at the light-heat conversion layer 41 is rapidly performed providing uniform temperature distribution even if non-uniform or gaussian distribution of light is received from the laser source 18. Thus printing efficiency and color uniformity is improved.

In operation the printer according to the third embodiment functions substantially as described in connection with the previous two embodiments.

Figure 5:
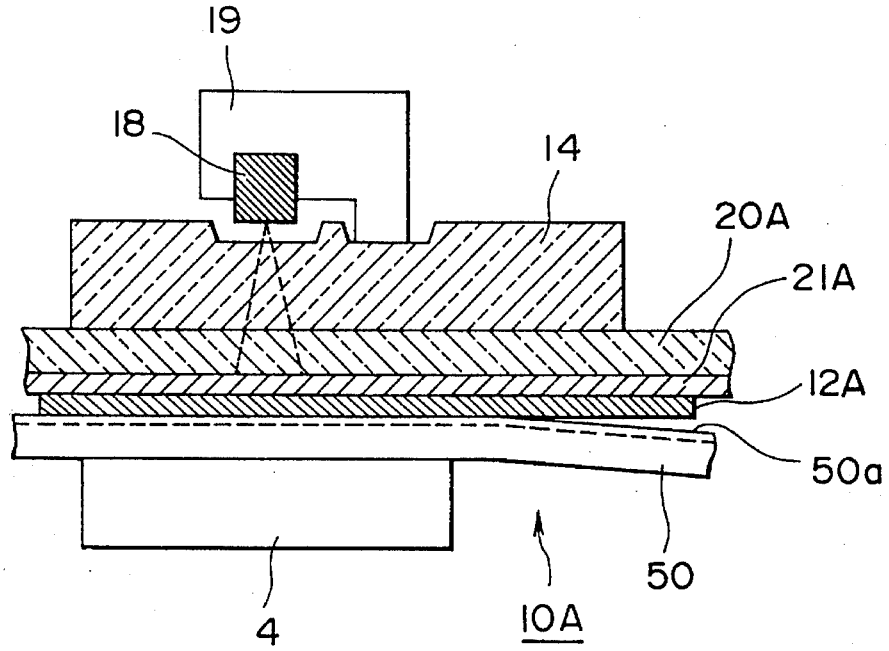
FIG. 5 is a cross-sectional view of a head assembly of a laser sublimation type printer according to a fourth preferred embodiment.

FIG. 5 shows a fourth embodiment of a laser sublimation type printer 1 according to the invention. It will be noted that, in the first, second and third embodiments described above, liquefied dye 12' is supplied to light-heat conversion means (21, 31, 41) to effect printing. However, it is also possible to provide the sublimation type dyes 12 thermally pressed with a binder in the form of a dye ribbon 12A, as shown in FIG. 5. According to this, the head portion 10 of the printer may comprise a head base 14 of glass, transparent ceramic, or the like, a light transmission layer 20A of a heat resistant light transmitting material (aromatic polyamide resin may also be used), a light-heat conversion layer 21A which may comprise a metallic thin film of nickel-cobalt alloy, for example, applied by vapor deposition, sputtering or the like. According to tills construction, the light-heat conversion layer 21A is selectively irradiated by the laser beam L from the laser source 18 for vaporizing dyes 12 contained in the dye ribbon 12A, for effecting printing.

According to this the structure of the head portion 10 of the printer 1 may be greatly simplified.

Figure 6:
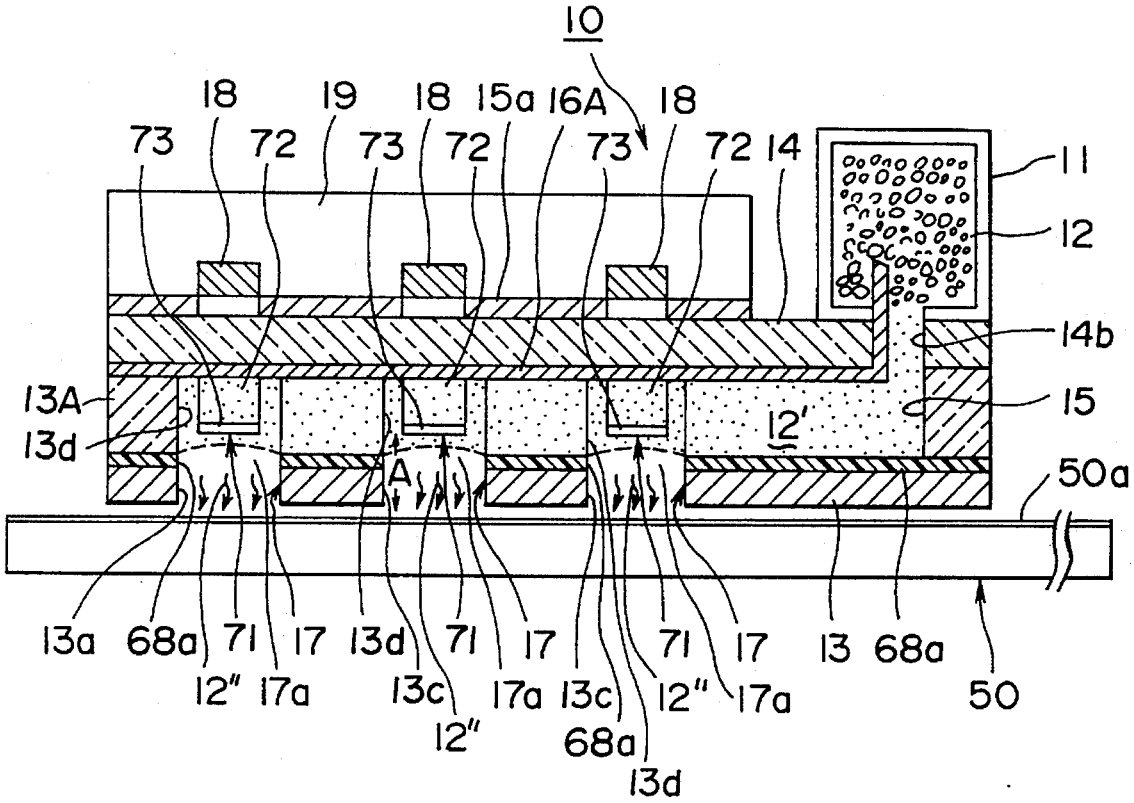
FIG. 6 a cross-sectional view of a head assembly of a laser sublimation type printer according to a fifth embodiment of the invention.

FIG. 6 shows a longitudinal cross-section of the head portion 10 according to a fifth embodiment of the invention. As may be seen the mounting stand 19 mounts a plurality of laser sources 18. With reference to the fifth embodiment, the materials and construction of the head portion 10 including the head base 14, the protective layer 13 and a spacer 13A provided between the head base 14 and the protective layer 13, will be described in detail referring to FIGS. 6–10.

Figure 7:
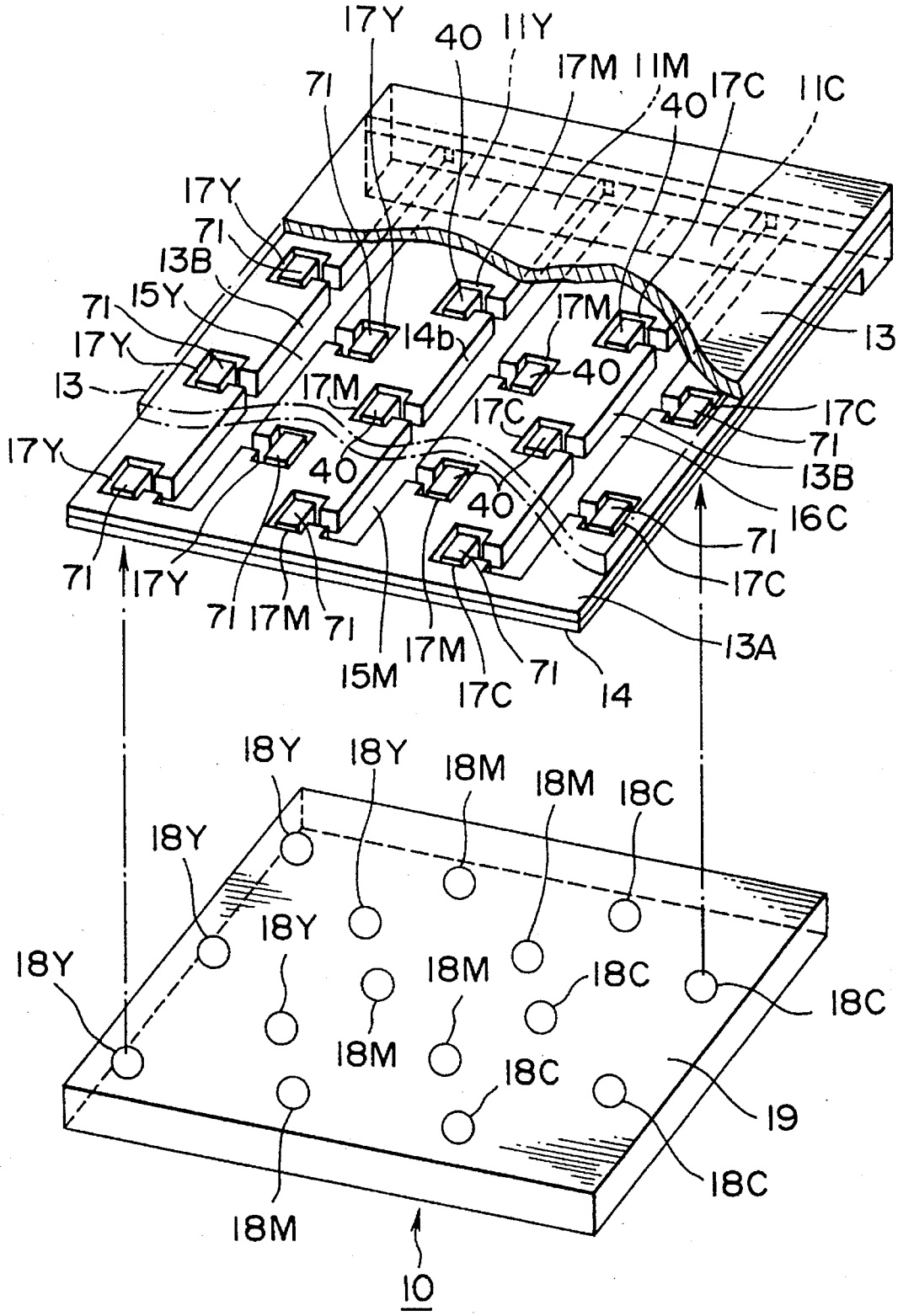
FIG. 7 is an inverted exploded perspective view of the head assembly of FIG. 6.
Figure 8:
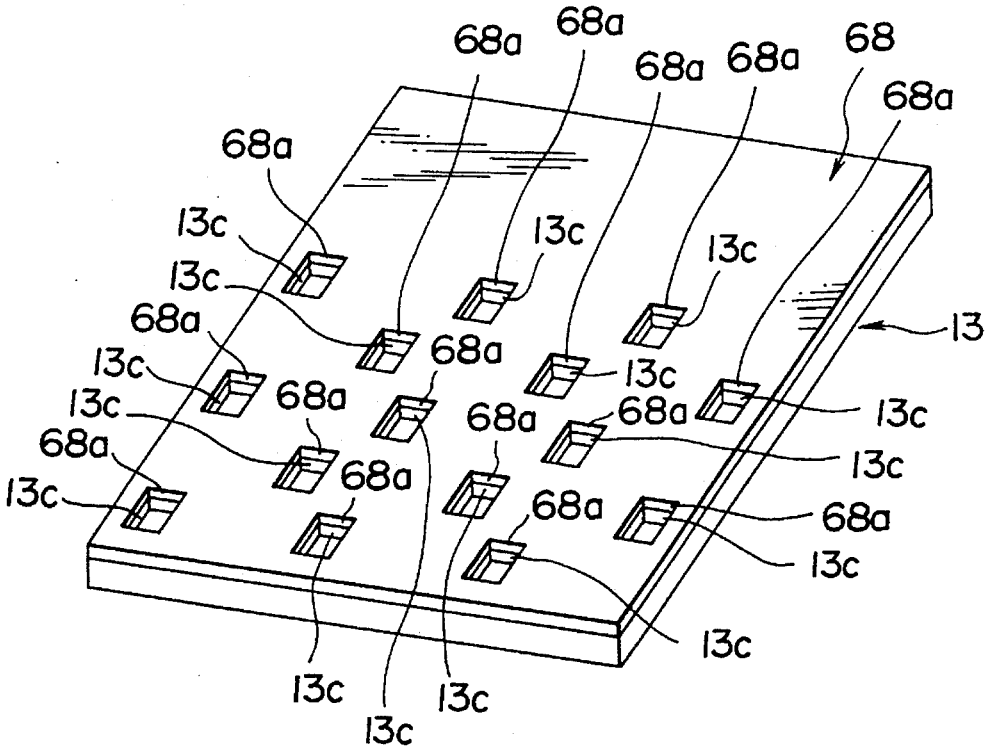
FIG. 8 is an inverted perspective view of a protective layer utilized in the head assembly of FIG. 6.
Figure 9:
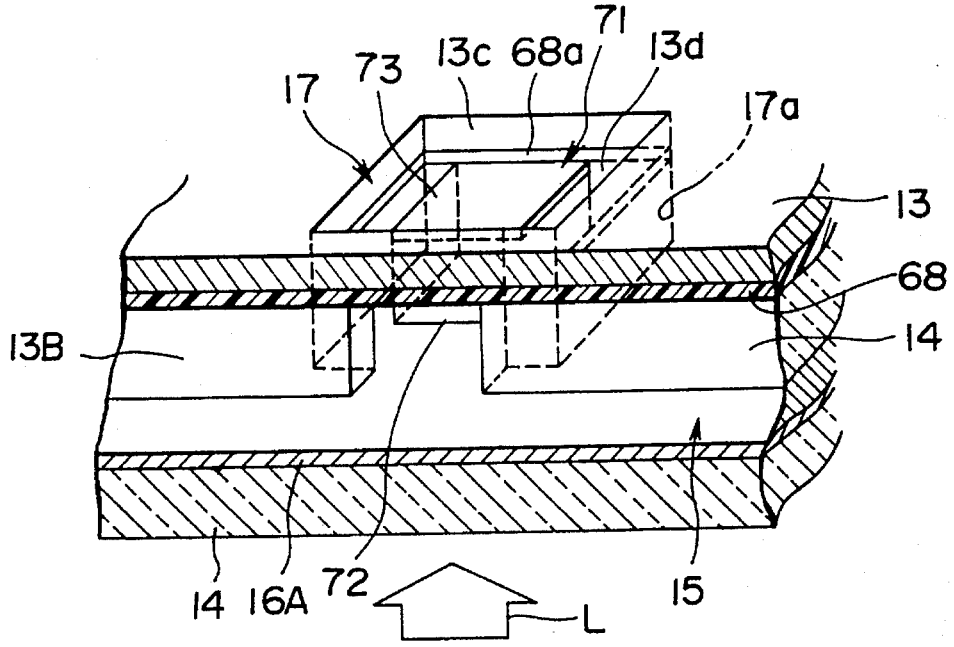
FIG. 9 is an inverted enlarged partial perspective view of a vaporizing section of the head assembly.

Referring now to FIG. 7, an inverted, cut-away perspective view of the protective layer 13 and spacer 13A is shown. The function of the protective layer 13 is to prevent contamination of the vaporizing pores 17*a* by dust, dirt, etc., while contacting the surface 50*a* of the photographic paper 50 under light pressure. The protective layer may be formed of glass, ceramic or tantalum, a metallic material having good thermal conductivity with excellent heat and wear resistance. As shown in FIGS. 8 and 9, the protective layer 13 is formed with a plurality of quadratic, prism-shaped openings 13*c* which serve as a lower side of the vaporizing pores 17*a* (for example, a pitch between adjacent openings may be established at 100μm). The openings 13*c* may be formed by etching processing, or the like.

The spacer 13A may be formed of glass, ceramic, polyethylene resin, metallic tantalum, or the like. The function of the spacer 13A is to balance or adjust the melting temperature of each of the liquefied dyes 12' and the temperature of a dye receiving surface layer 50*a* of the photographic paper 50, by transferring heat to the protective layer 13. As seen in FIGS. 6 and 9, the spacer 13A is formed with a plurality of quadratic prism-shaped openings 13*d* which also serve as part of the vaporizing pores 17*a* and, grooved openings 13B corresponding to the dye passages 15 extending from the side of each of the dye tanks 11 to the opposite side of the head base 14 to intercommunicate each of the vaporizing pores 17*a* respectively.

Further, a liquid dye pooling layer 68 is set between the protective layer 13 and the spacer 13A. The liquid dye pooling layer 68 is formed of a fluorine or silicon type transparent resin material which is heat resistant and chemically stable. The liquid dye pooling layer 68 is active to prevent liquefied dye 12' from leaking through the material of the protective layer and adhering to the surface 50*a* of the photographic paper 50. The liquid dye pooling layer 68 is formed with a plurality of quadratic openings 68*a* for forming the vaporizing pores 17*a*. It will be noted that the protective layer 13, the spacer 13A and the liquid dye pooling layer 68 are laminated together via an adhesive (not shown) having heat resistance and light-transmitting characteristics.

The head base 14 is formed to be as thin as possible and may be of a material such as glass, transparent ceramic or the like having a substantially high melting point, no heat molding characteristics, good light transmittance and low thermal conductivity. In order to reinforce the head base 14, it is possible to provide a reinforcement plate 15*a* between the head base 14 and the laser mounting stand 19. In addition, as seen in FIG. 6, at the side of each of the dye tanks 11, a connection pore 14*b* is formed for communicating with the dye passages 15. The head base 14, the reinforcing plate 14*a* and the laser mounting stand 19 are also joined together and to the protective layer 13, the spacer 13A and the liquid dye pooling layer 68 by adhesive having heat resistance and light-transmitting characteristics.

Figure 10:
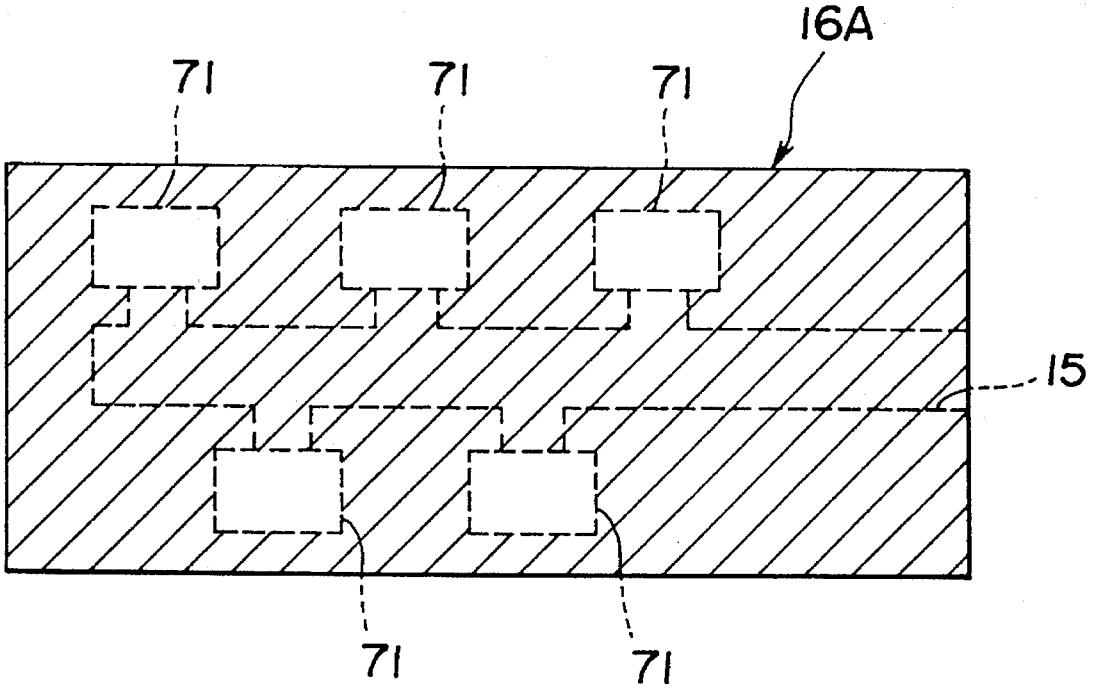
FIG. 10 is a schematic view of an arrangement of a heating plate and light-heat converting elements in the head assembly according to the fifth embodiment.

According to this embodiment, a heating plate 16A is provided rather that the embedded resistors 16 of the previous embodiments. The heating plate 16A may be formed of a carbon or silicon compound, for example, capable of generating heat at 50° C.–300° C. according to application thereto of an electric current, thus liquefying the sublimation type dyes 12 and maintaining them in a warm, liquid state. As shown in FIG. 6, end portions of the heating plate 16A are bent perpendicularly upward so as to extend into a lower portion of each of the dye tanks 11 so as to facilitate melting of the powder form dye 12 and promote the flow of liquid dye 12" and also to prevent clogging of the powder form solid dye 12 at the outlet of the dye tanks 11. As shown in FIG. 10, each of the heating plates 16A is arranged so as to surround the vaporizing sections 17 of the head portion 10 and thus is active to warm the spacer 13A, the protective layer 13 and also serves to heat the dye receiving surface 50*a* of the photographic paper 50.

As will be understood from the above description and FIGS. 6–10 the dye passages 15 are capillary tubes defined collectively by the head base 14, the grooved openings 13B of the spacer 13A, and the protective layer 13. While the vaporizing pores 17*a* are collectively formed by the openings 13*c* of the protective layer 13, openings 68*a* of the dye pooling layer 68 and openings 13*d* of the spacer 13A for forming the vaporizing pores 17*a* according to lamination with a heat resistant, light transmitting adhesive. Each of the vaporizing pores 17*a* constitutes minimum dot unit, for imprinting a single picture element. The vaporizing pores 17*a* are arranged in a so-called checkered pattern using the dye passages 15 as a boundary area between groupings of vaporizing pores 17*a* for vaporizing section 17Y (yellow), vaporizing section 17M (magenta) and vaporizing section 17C (cyan). According to this arrangement, a pitch between the vaporizing sections 17Y, 17M and 17C can be reduced to a spacing of not more than 30μm, which allows high image resolution to be achieved.

As set forth above, at a central lower portion of each of the vaporizing pores 17*a*, projected into the vaporizing pore 17*a* from the head base 14, a light heat conversion layer 71 is provided which is associated respectively with a laser source 18. The light heat conversion layer 71 may be of any of the configurations noted in connection with the previous embodiments and may include a light transmission component 72 for effecting conversion of the light of the laser beam L to heat for vaporizing a suitable amount of liquefied dye 12' present in the vaporizing pore 17*a*.

As may be seen in FIG. 6, according to the present embodiment, the empty space of the vaporizing pore 17*a*, with the light-heat conversion layer 71 projected thereinto, acts as a dye pool for always storing a constant amount of liquefied dye 12' and, according to capillary pressure present in the vaporizing pores 17*a*, an air space A is formed in each of the vaporizing pores 17*a* between the light-heat conversion layer 71 and the surface 50*a* of the photographic paper 50. The presence of the air space A provides additional insulating characteristics for further enhancing printer performance.

Figure 13:
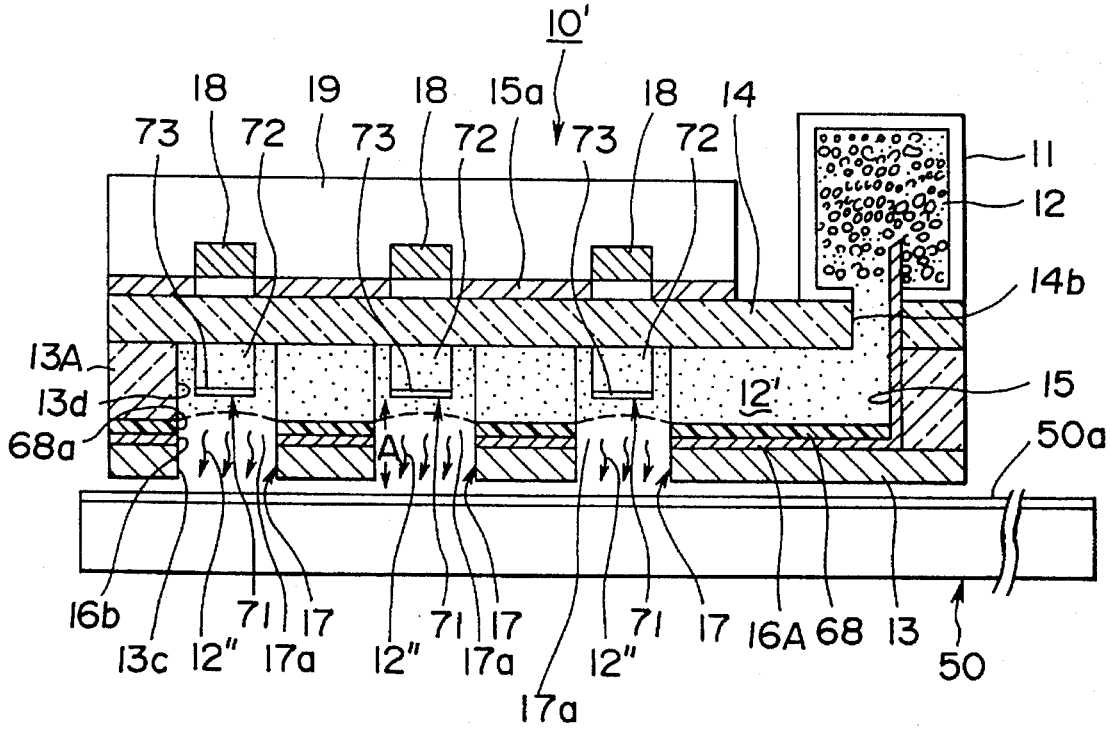
FIG. 13 is a cross-sectional view of a head assembly of a laser sublimation type printer according to a sixth preferred embodiment.
Figure 14:
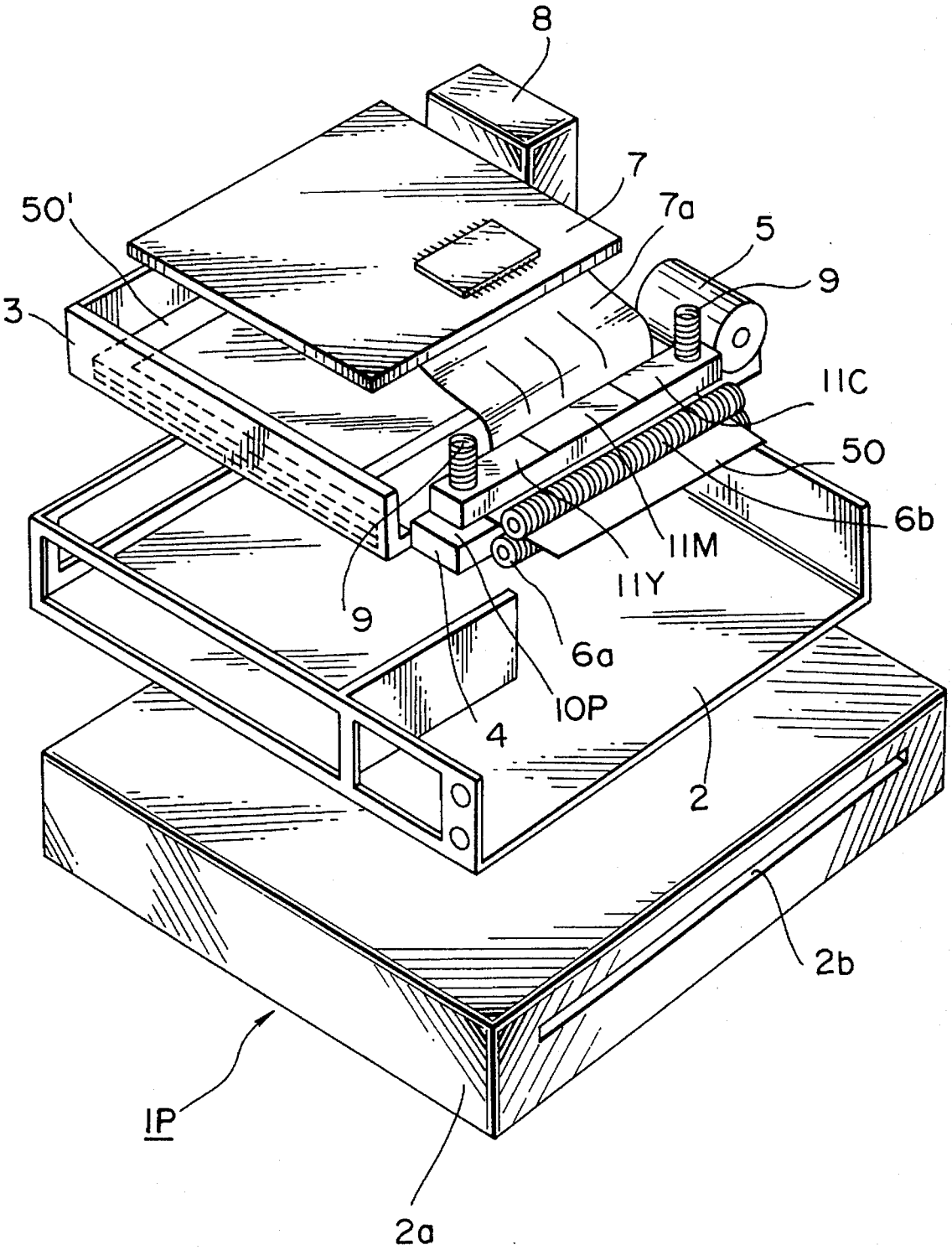
FIG. 14 (PRIOR ART)
FIG. 14 is an exploded perspective view of a conventional laser sublimation type color video printer.
Figure 15:
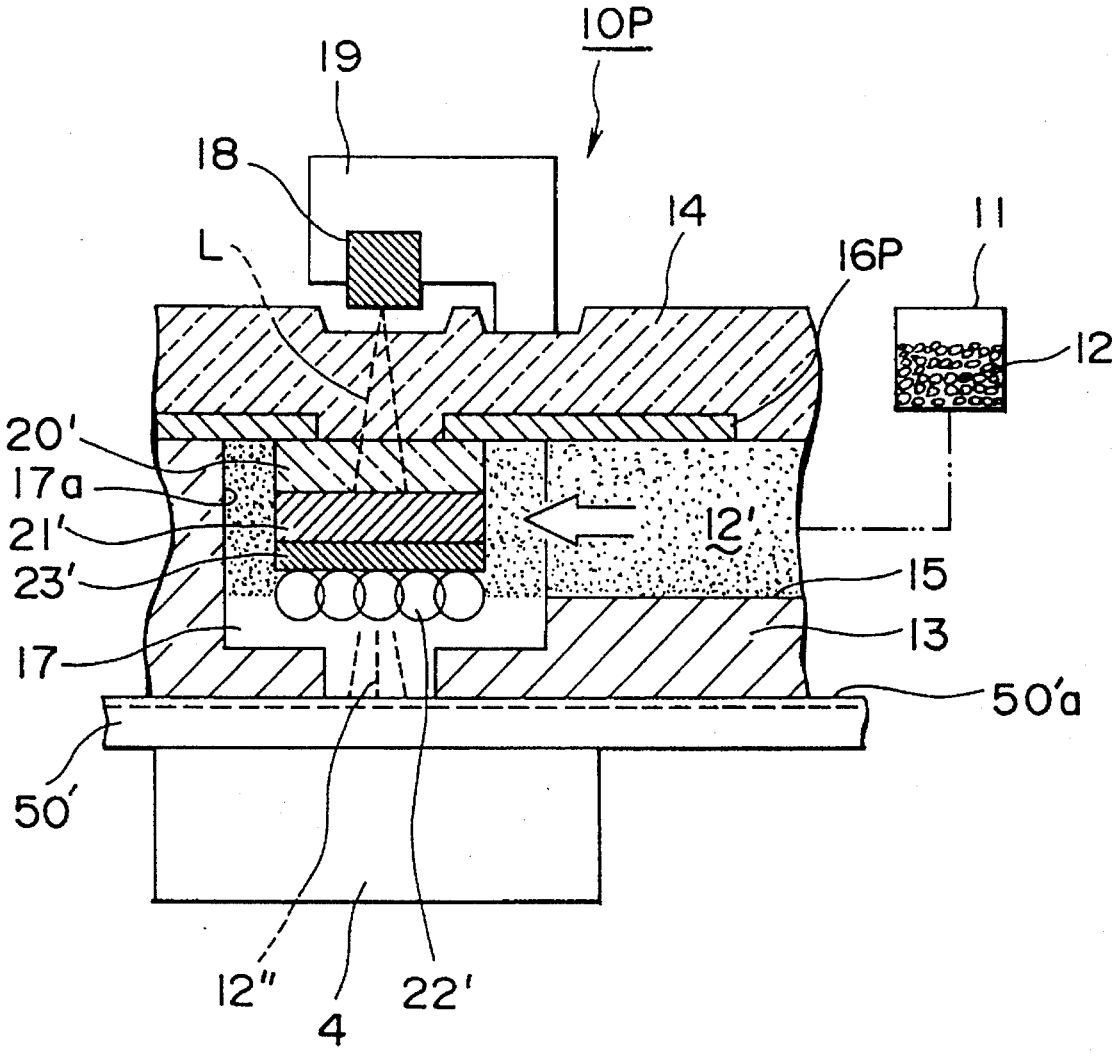
FIG.15 (PRIOR ART)
FIG. 15 is a cross-sectional view of a head assembly of the conventional printer of FIG. 14.
Figure 16:
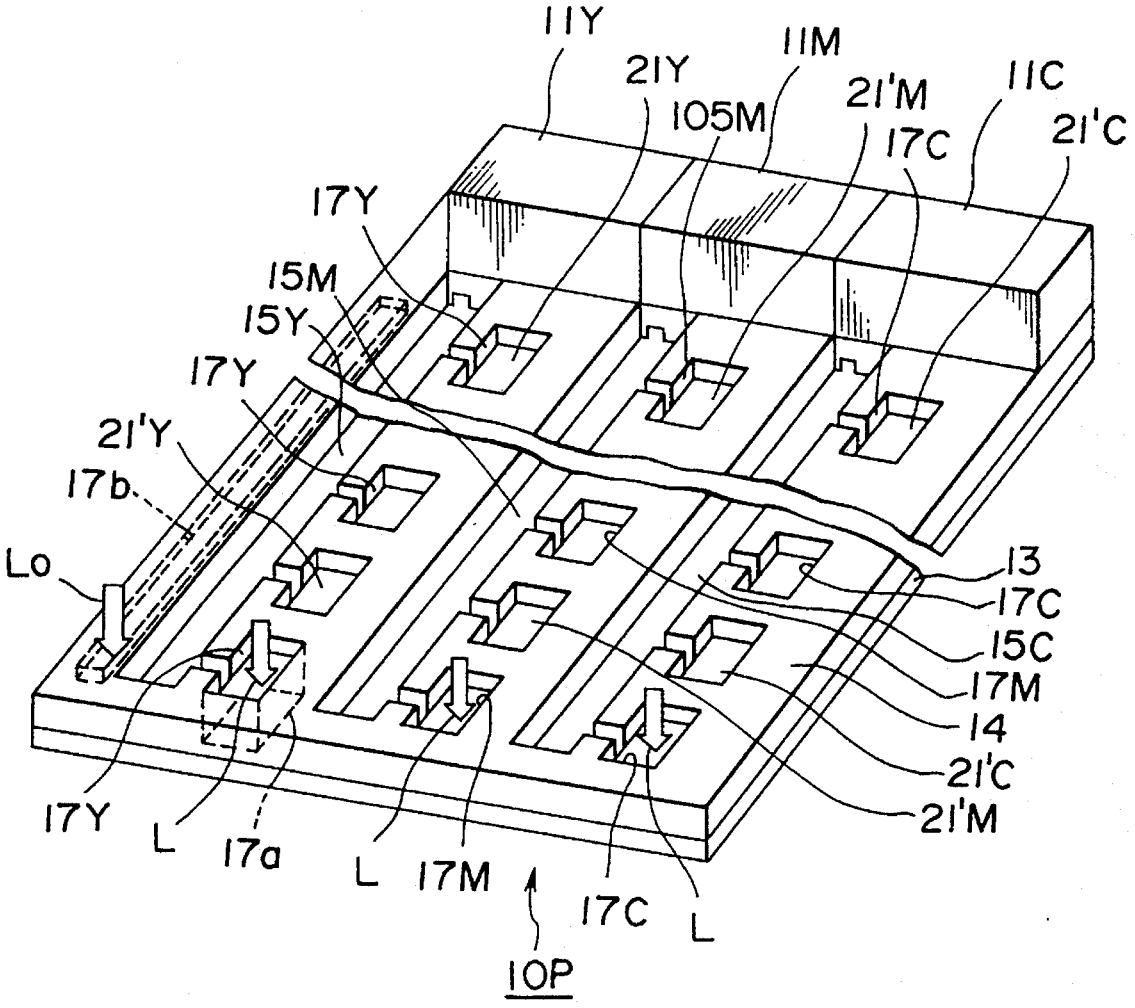
FIG.16 (PRIOR ART)
FIG. 16 is a perspective view of a head assembly for a conventional sublimation type laser printer.

Hereinbelow, a sixth embodiment of a head portion of a laser sublimation type printer according to the invention will be described with reference to FIG. 13.

According to the sixth embodiment, the heating plate 16A is provided on a lower side of the dye passage 15 between the liquid dye pooling layer 68 and the protective layer 14 for increased heating efficiency for facilitating the flow of liquefied dye 12' from the dye tanks 11 to the vaporizing pore 17a. According to this, the heating plate 16A is provided with a plurality of quadratic openings 16*b* which act in combination with the openings 13*c* of the protective layer 13, openings 68*a* of the dye pooling layer 68 and openings 13*d* of the spacer 13A for forming the vaporizing pores 17*a* according to amination with a heat resistant, light transmitting adhesive. Similarly to the previously described fifth embodiment, an end portion of the heating element 16A is arranged so as to extend into the dye tank 11 for promoting melting of the powder form solid dye 12 and smooth flow of liquefied dye 12'. In other respects the sixth embodiment is substantially identical to the previously described fifth embodiment.

Figure 11:
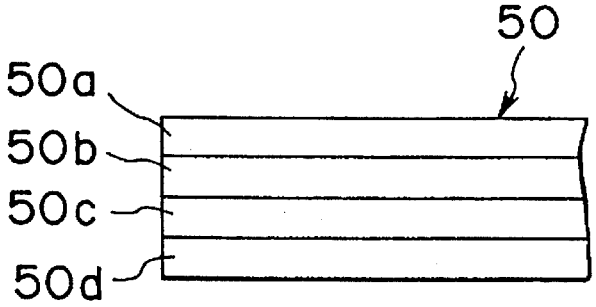
FIG. 11 is enlarged cross-sectional view of photographic paper adapted for optimal results when used with the laser sublimation type printer of the invention.

FIG. 11 shows a cross-sectional view of photographic paper 50 adapted for optimal performance with the printing method effected by the printer according to the invention. As may be seen in the drawing, the photographic paper 50 is comprised of a dye receiving surface 50*a* formed of a cellulose type resin or the like capable of absorbing the vaporized (sublimation type) dyes 12", a polypropylene layer 50*b* under the surface 50*a* having strong heat resistance and good moisture repellent characteristics, a base paper layer 50*c* and a polypropylene layer 50*d* for structurally balancing the polypropylene layer 50*b* to prevent warping of the photographic paper 50. These four layers are laminated together for forming a photographic paper 50 which will yield high-quality results with the printing arrangement of the invention.

Figure 12:
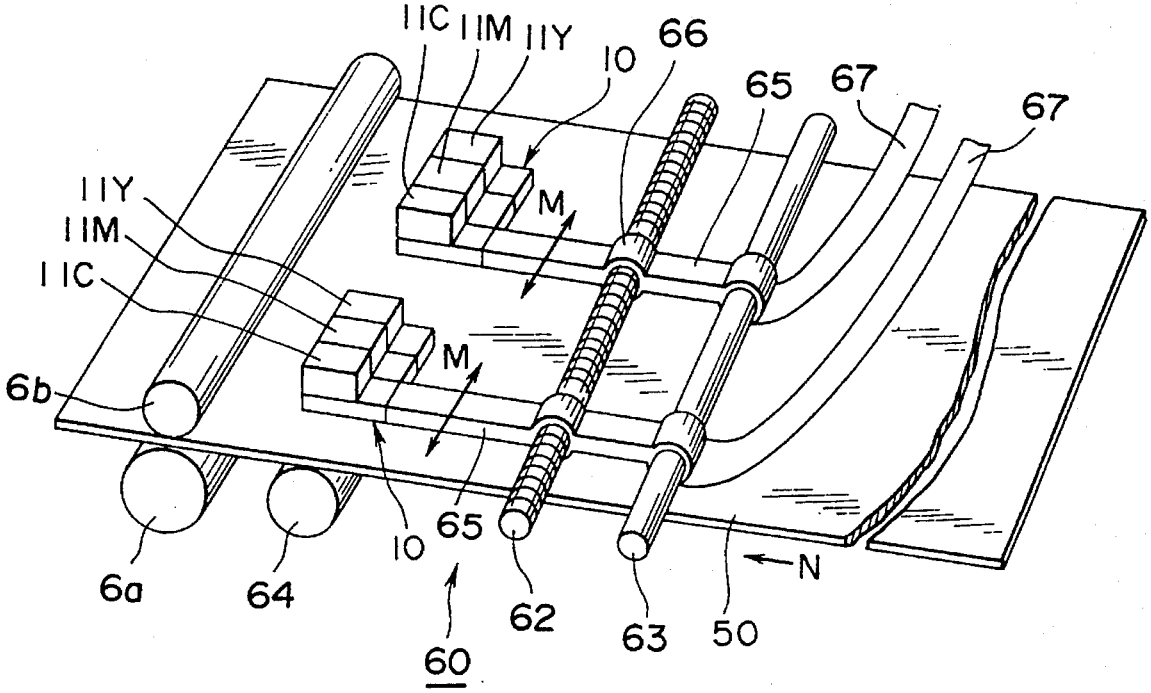
FIG. 12 is a perspective view showing a basic construction of a head mounting apparatus of a sublimation type printer according to the invention.

FIG. 12 shows a mounting structure 60 of a laser sublimation type printer 1 which movably mounts a pair of head portions 10, 10 which may be constructed according to any of the above-described embodiments. The head portions 10, 10 are respectively mounted on a threaded shaft 62 via arm portions 65, 65 each having a threaded opening 66 provided therethrough for receiving the shaft 62. The head portions 10 are capable of reciprocating movement in a head feeding direction, indicated by an arrow M, which is perpendicular to a paper feed direction, indicated by an arrow N in FIG. 12. A head receiving roller 64 is disposed under the head portions 10, 10 such that photographic paper 50 is interposed between the head portions 10, 10 and the head receiving roller 64 during printing. If the line M is defined as a single line of an image to be printed, the mounting structure 60 enables the head portions to print two lines at one pass, which may be of different colors, for example. Each of the head portions are connected to a control portion (not shown) of the printer via a flexible wire harness 67.

It will be noted that, although the abovedescribed embodiments are drawn to a color laser printer using sublimation type dyes, the present invention is not limited to the use of such dye, and is not limited to color printing. The arrangement of the invention may also be preferably applied to black and white, monochrome, or other types of printing using a color medium other than sublimation type dyes 12.

Also, although the fifth and sixth embodiments include a heating plate 16A, a portion of which is extended into an outlet of each of the dye tanks 11, it is possible, according to the invention to additionally provide the head portions 10 of these embodiments with the non-return valve 24 and the vibrating units 25 of the first to third embodiments for further enhancing the speed and efficiency of the laser sublimation type printer. Conversely, the heating plate 16A of the fifth and sixth embodiments may also be preferably introduced to the structure of the head portions 10 of the first three embodiments.

In addition, since the structure of the head portion is simple, comprising the head base 14, the spacer 13A and the protective layer 13, even when the minimum tolerances are provided for spacing of the vaporizing pores 17*a* and the vaporizing sections 17Y–17C, according to etching processing or the like, the options for selection of materials for manufacturing the head portion are many, allowing additional cost reduction to be contemplated.

Also, according to the provision of the air space A between the surface 50*a* of the photographic paper 50 and the light-heat conversion layer 71 (i.e. 21, 31, 41) an insulated environment is provided for vaporization of the sublimating liquefied dye 12' defined by the interior of the vaporizing pore 17*a*, the pool of liquefied dye 12' therein and the surface 50*a* of the photographic paper 50. Thus, foreign matter such as dust etc., is prevented from entering the vaporizing pores 17*a* and a minimum amount of energy may be expended for vaporizing the liquefied dyes 12' since excess heat will not escape into the surface 50*a* of the photographic paper 50. Accordingly, an energy efficiency of the printer is improved.

In addition, according to the invention, since neither the light transmission component 72 (i.e. heat resistant, light-transmitting layers 20, 30) nor the light-heat conversion layer 71 (i.e. light-heat conversion layers 21, 31, 41) directly contact the surface 50*a* of the photographic paper 50. The structure of the vaporizing sections 17 can be simplified and print error, such as reverse imprinting during color overlaying and the like, may be surely prevented.

According to the invention, photographic paper such as described hereinabove in relation to FIG. 11 may be utilized in which no light-absorbing layer need be provided, thus irradiation of the paper by a dedicated laser beam Lo for whitening the light-absorbing agent is not necessary and the apparatus may be simplified while the cost of the photographic paper may also be reduced.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A laser sublimation type printer, comprising:

a solidified dye accommodating tank containing solid form sublimation type dye and mounted on an upper side of a head portion of said printer, said tank having an outlet;

a vaporizing section including a vaporizing pore which is open on a lower side of the vaporizing section through a protective layer which contacts a surface of photographic paper on which printing is to be carried out, said vaporizing pore having an interior space;

a liquefied dye accommodating passage defined in said head portion and communicating said outlet of said dye tank with said interior space of said vaporizing pore;

heating means provided proximate said liquefied dye accommodating passage for melting said solid form sublimation type dye and maintaining said dye in a liquid state;

light-heat converting means projected into said vaporizing pore, said light-heat converting means having a lower side for vaporizing liquid dye introduced to said vaporizing pore from said liquefied dye accommodating passage, a total area of said lower side of said light-heat converting means being limited to an imprint area of the vaporized dye on said photographic paper during a single vaporizing operation of said printer;

a laser source mounted above each of said light-heat converting portions and active to effect said vaporizing operating by irradiating said light-heat converting means for vaporizing liquefied dye adhered to said lower side of said light-heat converting means.

2. A laser sublimation type printer as set forth in claim 1, wherein a means for pressurizing and supplying dye is provided in said liquefied dye accommodating passage.

3. A laser sublimation type printer as set forth in claim 1, wherein a one-way valve is provided at said outlet of said solidified dye accommodating tank between said tank and said liquefied dye accommodating passage.

4. A laser sublimation type printer as set forth in claim 2, wherein said dye pressurizing and supply means is constituted by a bimorph active as a vibrating unit.

5. A laser sublimation type printer as set forth in claim 2, wherein said dye pressurizing and supply means is constituted by a piezo-element active as a vibrating unit.

6. A laser sublimation type printer as set forth in claim 1, wherein said heating means is provided in said liquefied dye accommodating passage.

7. A laser sublimation type printer as set forth in claim 1, wherein a portion of said heating means is extended into a portion of said solidified dye accommodating tank.

8. A laser sublimation type printer as set forth in claim 1, wherein said light-heat converting means is comprised of a metallic thin film adhered to a heat resistant, light transmitting base material.

9. A laser sublimation type printer as set forth in claim 8, wherein said metallic thin film is a nickel-cobalt alloy deposited by vapor deposition on said heat resistant, light transmitting base material.

10. A laser sublimation type printer as set forth in claim 8, wherein said metallic thin film is a nickel-cobalt alloy deposited by sputtering on said heat resistant, light transmitting base material.

11. A laser sublimation type printer as set forth in claim 1, wherein a means for retaining liquid dye is laminated to a lower side of said light-heat converting means.

12. A laser sublimation type printer as set forth in claim 11, wherein a lower surface of said liquid dye retaining means is formed in a mesh shape

13. A laser sublimation type printer as set forth in claim 1, wherein a lower side of said light-heat converting means is formed as a mesh shape for retaining liquified dye introduced to said vaporizing pore.

14. A laser sublimation type printer as set forth in claim 8, wherein said heat resistant, light transmitting base material is formed of an aromatic polyamide resin.

15. A laser sublimation type printer as set forth in claim 8, wherein said heat resistant, light transmitting base material is formed of a length of optical fiber.

16. A laser sublimation type printer as set forth in claim 15, wherein said light-heat converting means and said optical fiber are surrounded by an insulation material.

17. A laser sublimation type printer as set forth in claim 1, wherein said vaporizing section comprises a plurality of vaporizing pores each irradiated respectively by a corresponding one of a plurality of laser sources.

18. A laser sublimation type printer as set forth in claim 1, wherein said vaporizing section comprises a plurality of vaporizing sections arranged adjacently on said head portion, one of said liquefied dye passages being disposed between adjacent ones of said vaporizing sections.

19. A laser sublimation type printer as set forth in claim 18, wherein a lower side of each of said vaporizing pores is formed as a quadratic, prism shaped opening a size of which corresponds to a single picture element of a printed image produced by said printer.

20. A laser sublimation type printer as set forth in claim 1, wherein an air space is provided between a lower side of said light-heat converting means and a surface of said photographic paper

21. A laser sublimation type printer as set forth in claim 1, wherein said head portion comprises an upper head base and a lower protective layer, and said liquefied dye passage is formed as a capillary tube defined between at least said upper head base and said lower protective layer of said head portion.

22. A laser sublimation type printer as set forth in claim 21, wherein said lower protective layer is formed of tantalum.

23. A laser sublimation type printer as set forth in claim 21, wherein a spacer is disposed between said head base and said protective layer, said capillary tube being defined between said head base, said spacer and said protective layer.

24. A laser sublimation type printer as set forth in claim 23, wherein said spacer is formed of tantalum.

25. A laser sublimation type printer as set forth in claim 21, further including a dye pooling layer disposed above said protective layer.

26. A laser sublimation type printer as set forth in claim 25, wherein said dye pooling layer is formed of fluorine resin.

27. A laser sublimation type printer as set forth in claim 25, wherein said dye pooling layer is formed of silicon resin.

28. A laser sublimation type printer as set forth in claim 1, wherein said heating means comprises an electrical resistor.

29. A laser sublimation type printer as set forth in claim 1, wherein said heating means is a plate formed of a carbon material to which an electrical current is applied.

30. A laser sublimation type printer as set forth in claim 29, wherein said heating means selectively generates temperatures of 50°–300° C. according to application of said electrical current.

31. In combination, a laser sublimation type printer and a photographic paper comprising:

a photographic paper comprised of a dye receiving surface layer, a polypropylene layer, a base paper layer and a second polypropylene layer;

a solidified dye accommodating tank containing solid form sublimation type dye and mounted on an upper side of a head portion of said printer, said tank having an outlet;

a vaporizing section including a vaporizing pore which is open on a lower side of the vaporizing section through a protective layer which contacts a surface of said photographic paper on which printing is to be carried out, said vaporizing pore having an interior space;

a liquefied dye accommodating passage defined in said head portion and communicating said outlet of said dye tank with said interior space of said vaporizing pore;

heating means provided proximate said liquefied dye accommodating passage for melting said solid form sublimation type dye and maintaining said dye in a liquid state;

light-heat converting means for converting light to heat projected into said vaporizing pore, said light-heat converting means having a lower side for vaporizing liquid dye introduced to said vaporizing pore from said liquefied dye accommodating passage, a total area of said lower side of said light-heat converting means being limited to an imprint area of the vaporized dye on said photographic paper during a single vaporizing operation of said printer;

a laser source mounted above each of said light-heat converting means and active to effect said vaporizing operation by irradiating said light-heat converting means for vaporizing liquefied dye adhered to said lower side of said light-heat converting means.

32. A laser sublimation type printer as set forth in claim 21, wherein said heating means is formed as a heating plate provided at a lower side of said liquefied dye accommodating passage and which further acts to heat a surface of said photographic paper via said protective layer.

* * * * *